United States Patent [19]

Weston

[11] 4,365,169

[45] Dec. 21, 1982

[54] RANDOM PULSE DETECTOR SYSTEM

[76] Inventor: Allen H. Weston, 515 Hobart Rd., Marshall, Mich. 49068

[21] Appl. No.: 269,808

[22] Filed: Jun. 3, 1981

[51] Int. Cl.[3] ..... H01H 3/34

[52] U.S. Cl. ..... 307/141.4; 307/157

[58] Field of Search ..... 307/140, 141, 141.4, 307/157

[56] References Cited

U.S. PATENT DOCUMENTS

| | | | |
|---|---|---|---|
| 3,225,265 | 12/1965 | Krause et al. | 307/157 X |
| 3,763,377 | 10/1973 | Weston | 307/140 |
| 4,207,501 | 6/1980 | Smallegan | 307/141 X |
| 4,219,741 | 8/1980 | Von Gunter | 307/141 |

*Primary Examiner*—Michael L. Gellner

[57] ABSTRACT

Random voltage spike incident to any appliance load change in electrical supply circuit is sensed by a triac used to close a time limited holding circuit for an electric light circuit to provide random on/off lights "at home" indication for unoccupied premises.

11 Claims, 11 Drawing Figures

RANDOM PULSE DETECTOR SYSTEM

BACKGROUND OF THE INVENTION

In my prior U.S. Pat. No. 3,763,377 issued on Oct. 2, 1973 I disclosed a Random Cycle Load Switch including electrical circuitry in which a secondary load such as a lamp receives current during a random period when a primary load, such as a refrigerator motor, is running thus providing means whereby a light or lights in the home may be automatically turned on and off in a random fashion while the premises are unoccupied.

SUMMARY OF THE INVENTION

A further development of the system disclosed herein supplements the basic appliance responsive master unit by the addition of remote module units which can be plugged into electrical outlets in any room where it is desired to have lights turned on and off simply plugging the cords of any household lights into the other side of the remote units. Pulses in the supply current generated by a triac in the master unit control the duration of the "on" cycle of the remote units. In this manner several lights throughout the house responsive to control of the master unit provide the appearance of occupancy in several rooms, again on a random basis, when the appliance power load is on.

In a still further improvement, the preferred embodiment disclosed herein dispenses with dependence on an "on" condition of any particular appliance as the control for random light circuits. Instead provision is made for triac random detection of voltage spike pulses arising from any significant change in power demand anywhere in the house electrical supply system such as induced by the automatic switching of a furnace motor, gas or electric water heater, refrigerator, air conditioner, dehumidifier, or even neighbor appliances or lights manually switched on in a common neighborhood circuit on the same shared power line transformer from the general public electrical power supply. Detection of the pulses is employed to close a circuit in any pulse detector module which may be plugged into the electrical outlet in any room with built-in timing control for limiting the duration of time that such light circuit will remain on. Both sensitivity as to the magnitude of pulse detection as well as the duration time for individual light circuits will vary within production tolerances enhancing the random effect of lights going on and off at different times in the various rooms where the pulse detectors are located.

The basic circuitry allows a triac to be used as a pulse generator and control with pulse detection capabilities. One characteristic of the triac is that as a sine-wave is switched by the reduced voltage at the gate, a voltage spike is produced by the abrupt switching of the load. This effect is enhanced by the type of load e.g. inductive, capacitive or high inrush as in an incandescent light. The pulse so produced is coupled to the supply source by the triac.

The power line "noise" which normally exists on any circuit due to loads being switched on and off is used as the electrical energy to provide the random triggering source to the triac circuit. The resulting system is not dependent on and does not necessarily sense an "on" state condition of some other electrical element. Furthermore, since the triac switching pulse has a "signature" its characteristic signal can be produced and sensed over and above normal line noise if so desired.

This allows the phase relationship of the pulse on the waveform also to be utilized to control and be received at various units "tuned" to receive the phased pulses.

DETAILED DESCRIPTION OF THE INVENTION

Figure 1:
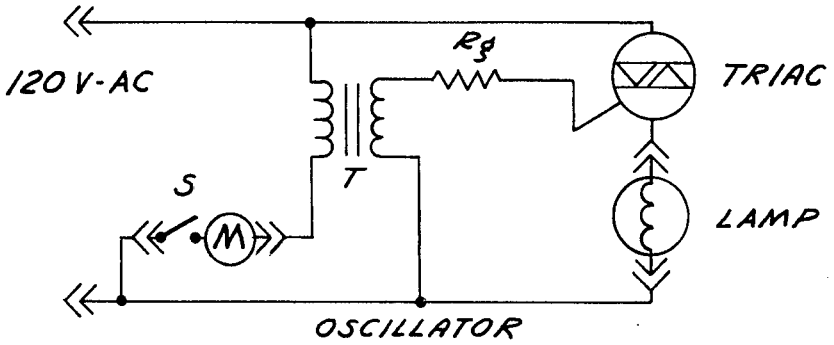
FIG. 1 shows diagrammatic circuitry for an oscillator which produces pulses or noise spikes that can be utilized to control a suitable detection system.
Figure 2:
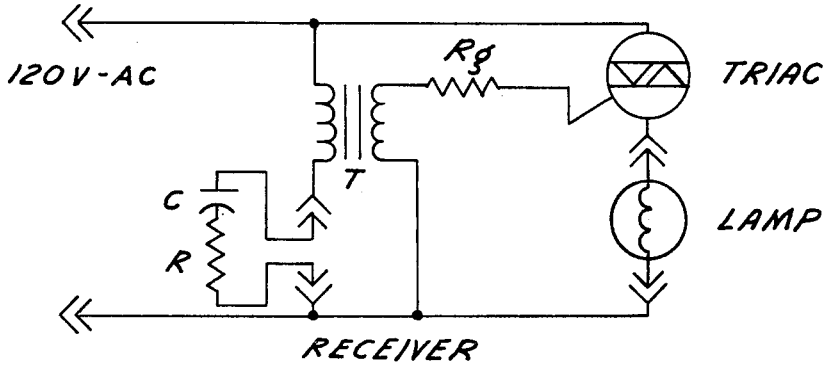
FIG. 2 shows circuitry for a receiver providing a detector circuit without the motor of FIG. 1.
Figure 3:
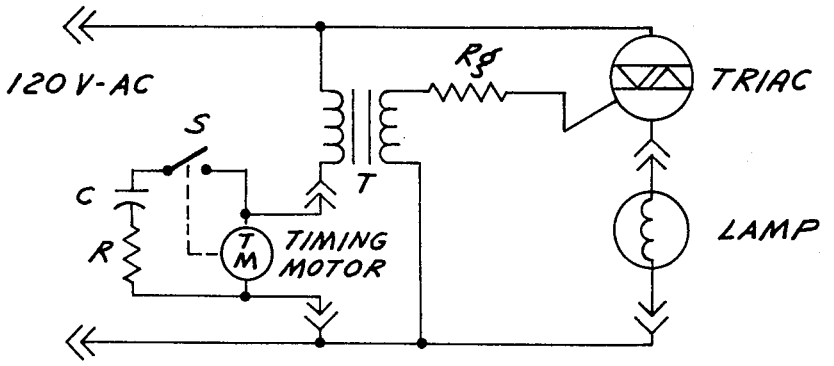
FIG. 3 illustrates the possibility of using the circuitry of FIG. 2 in remote units in conjunction with standard timers and relays.
Figure 4:
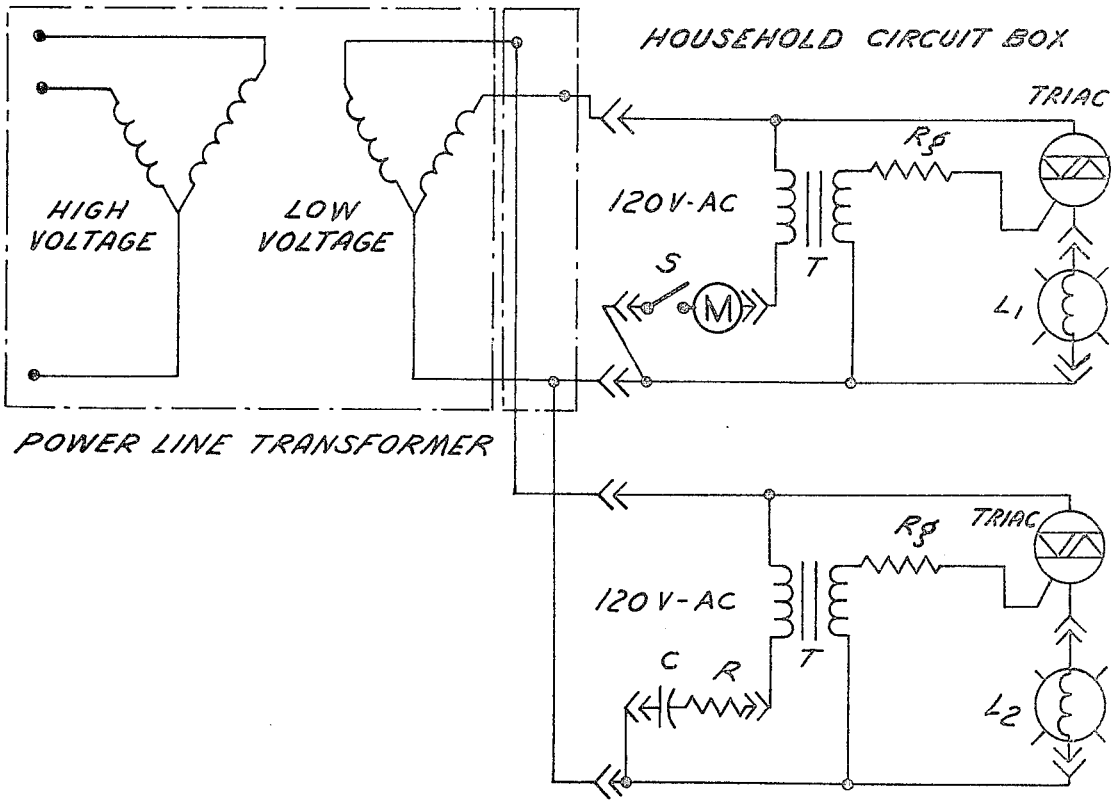
FIG. 4 illustrates circuitry for a power line transformer and household circuit box capable of activating remote units on a different side of a 120/120 neutral household electrical supply.
Figure 5:
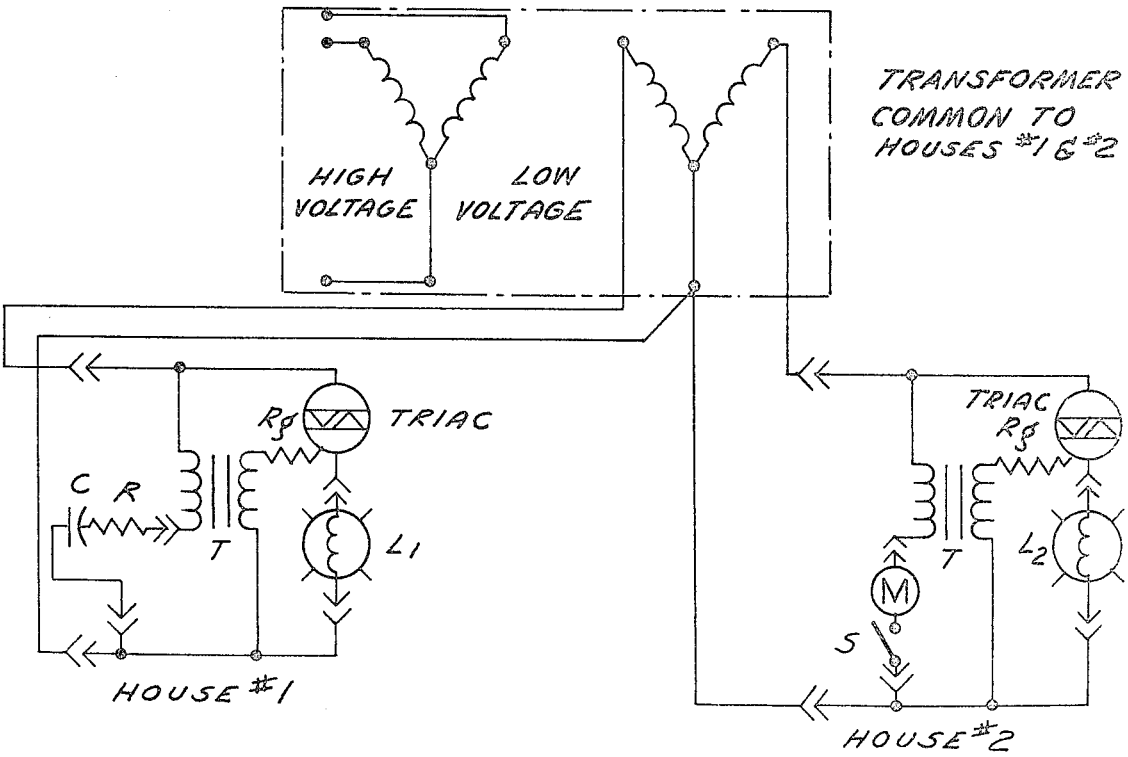
FIG. 5 illustrates circuitry for remote units located outside a normal household circuit which may be controlled by the control pulses in a common transformer connection.
Figure 6:
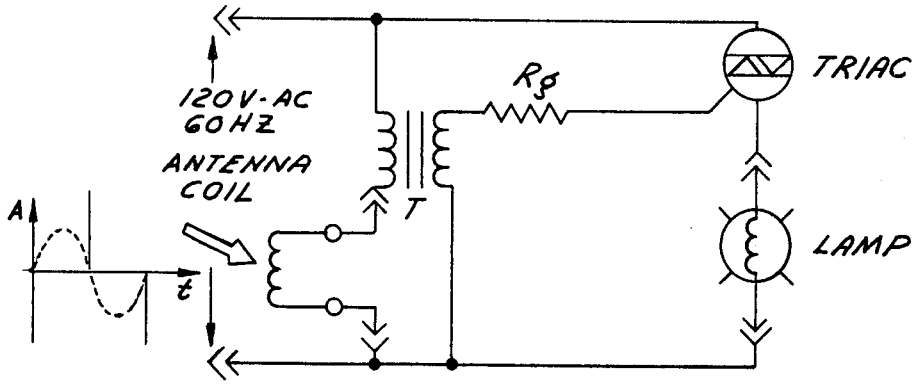
FIG. 6 illustrates a detector circuit for sensing the electro-magnetic waves propagated through the air corresponding to the created pulses of a master unit through a suitable antenna structure coupled into the current transformer to detect line pulses.

The circuitry shown in FIG. 1 produces pulses or noise spikes that can be utilized to control a suitable detection system. It is the on-off bi-directional semiconductor switch which produces an on-off voltage pulse in response to gate control pulses. The same circuit that produces the pulses can be utilized remotely to detect and control in response to a master controlling element. The pulse so generated is of sufficient magnitude that transmission is easily accomplished within the same power supply lines that support the circuits electrical connection and may connect a remotely located similar circuit so located that it responds to the control of the master unit. The advantage of this improvement over the disclosure of U.S. Pat. No. 3,763,677 is to provide the gating pulses at no extra expenditure of effort to virtually unlimited remote detector stations. Thus, the motor of FIG. 1 need not be repeated since a detector circuit shown in FIG. 2 will receive the control pulses to the gate of the remote triac and thus control a remote load. Clear advantages are as follows:

1. No extra wiring is required between remote units to the master control unit. Existing wiring for the supply circuit is used.
2. Usage of a lamp or load at the motor sensing unit need not be utilized.
3. Remote units may be used in conjunction with standard timers and relays to switch the necessary detection circuit into or out-of the remote system's circuit completely external to the remote unit as shown in FIG. 3 in which case the motor as such is not necessary for the electronics.
4. Remote units can be activated even though the remote unit is on a different side of a 120/120 neutral household electrical supply as shown in FIG. 4.
5. Remote units can be located outside a normal household circuit and still be controlled by the control pulses in a common transformer connection as shown in FIG. 5.
6. Suitable antenna structures as shown in FIG. 6 couple into the current transformer to detect line pulses, and may be added to the detector circuit to sense the electro-magnetic waves propagated through the air corresponding to the created pulses of the master unit.

These circuits are directly applicable to a remote control lighting or similar control system and have been found in practice to provide sufficient workable utility which obviates the need for a motor or similar load in the circuit and thus increases the utility of the device as a random pulse detector and control for providing random lighting to deter looting and vandalism in private and public areas.

Figure 7:
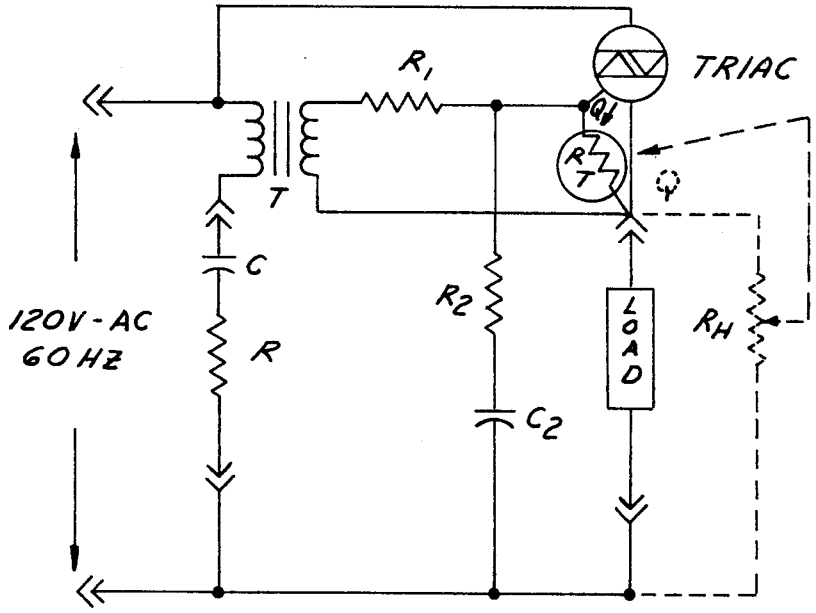
FIG. 7 shows a circuit resulting from the latest development wherein the necessity of a particular appliance motor control is eliminated.

A preferred embodiment of the invention is illustrated in the circuit of FIG. 7 wherein the necessity of the motor is eliminated and pulses detected on the incoming supply lines are detected. These pulses are generally produced by a variety of electrical power consuming appliances as they switch on and off under manual or automatic control as in a furnace or air conditioner blower motor system thermostatically controlled, a refrigerator random cycling action, incandescent lights being turned on at dusk and being manually switched on in a common neighborhood circuit on the same shared power line transformer. The solenoid on the gas burner of a water heater valve or similar furnace valve or electrical water heater switch. Thus on any power line many random pulses are commonly generated which can be utilized to energize a suitable control circuit and it is these pulses which are utilized to trigger the control circuit of FIGS. 7, 8 and 9 to the conducting mode. As this occurs, the circuit holds the "on" state until suitable means allows the gate signal to dissipate to a sufficient low value that the triac opens the circuit to the load.

In its simplest form the heat from the triac is utilized as the method to heat the varistor which appropriately changes its resistive value and removes the gate signal from the triac. This shuts off the triac heating caused by the internal resistance and the external current drawn by the connected load. With the load turned off the triac again cools and allows the varistor/thermistor resistance to increase thereby producing a relatively high resistance and a resistance to the gate potential to ground. In this state the control circuit is now ready for sensing and holding an external voltage spike as may occur on the line. Since the voltage spike is generally random in nature and the temperature cool down cycle of the varistor/thermistor is dependent on ambient room conditions which may vary from hour to hour or day and night or heating season to cooling season, the randomness of the unit is enhanced.

The "Remote Module" or pulse coupling circuit can be plugged into the outlet of a conventional light timer, the timer cord plugged into the "Remote module connector" and the combination can be set to operate within desired hours. Other applications would be to connect a suitable window switch normally open when the window is closed which would detect when a window is open and switch on a circuit containing the remote module and thereby turn on a lamp to produce pulses that would be detected within the house or at the neighbors via another unit with just a "Remote module" as a receiver element. The sensitivity is adjustable by the selection of the proper gate resistance and primary coupling circuit values.

With further reference to the circuit shown in FIG. 7 the optional heating resistor shown as $R_h$ (dotted) may be used as a heat producing element in addition to or in place of the triac heat output. No power is consumed through the resistor $R_h$ prior to the triac on-state. Upon receiving a pulse of sufficient magnitude to trigger the triac to a conducting state, the $R_h$ resistor will provide a hold-in function even without the load being connected as it will consume electrical power and dissipate the electrical power into heat. Thus, if a cycle of some duration shorter than the normal control circuit cycle was intrinsic to the load element, the optional resistor of $R_h$ would maintain the control circuit function and timing until the next pulse was received. It should be noted that the lamp disclosed in FIGS. 1–6 is not necessarily required as a motor, solenoid, or other current drawing load may be used. Without $R_h$ the current drawn by the load must be above a finite level to hold in the triac.

Figure 8:
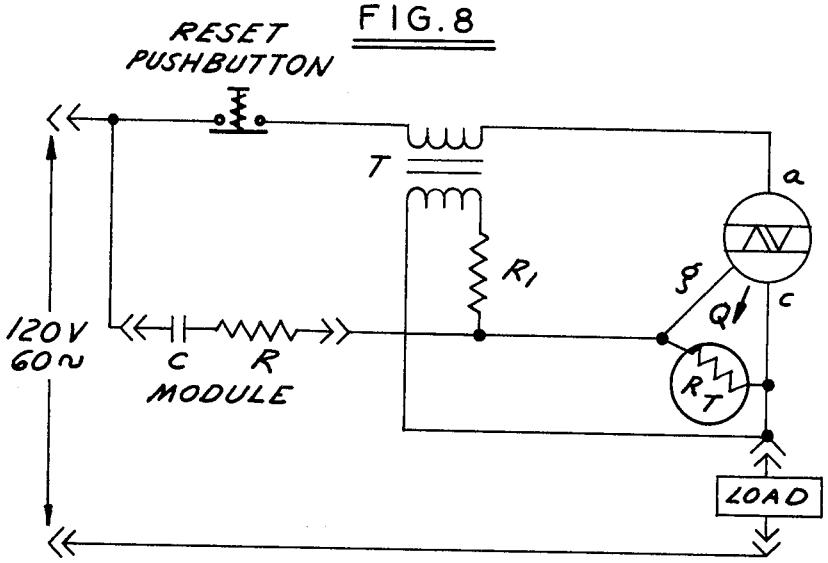
FIG. 8 illustrates circuitry for an application where high and low sides of an AC line are connected to the Random Pulse Detector including a push button to allow manual reset.

FIG. 8 shows an application where high and low sides of an AC line are connected to the Random Pulse Detector. A push button has been added to allow a manual reset of the load output to the off state. The push button simply interrupts the circuit to the load and the gating circuit that holds in the triac. This detector would be directly applicable to the wall plug-in type unit. The load is plugged into the Random Pulse Detector and the "Remote Module" consisting of a resistor and capacitor in series is connected across the Module terminals. A pulse of sufficient magnitude on the supply line is detected and the load is switched to the on-state and held on. Heat from the triac warms the varistor/-thermistor across the gating circuit to shunt the gate circuit and thereby lower the magnitude of the gating signal as seen by the triac to a sufficiently low value to shut off the triac. The varistor/thermistor cools and the resistance increases to a point where the triac will again receive a sufficiently high signal to potentially turn on the circuit to the load. However, the Random Pulse Detector must wait for a pulse to occur on the supply line. Only when this pulse occurs will the unit switch the load back on.

Thus, with no extra equipment except an external load, a random control function is generated. The randomness is a significant improvement over the use of a refrigerator or similar means since no direct coupling to an appliance is required, more pulses from other sources are possible for pulse excitation to the Random Pulse Detector, appliances need not be moved, unplugged, nor specially adjusted for a long or short cycle, and the obvious and repeatable function of a standard lamp and timer will not be produced by the Random Pulse Detector.

Figure 9:
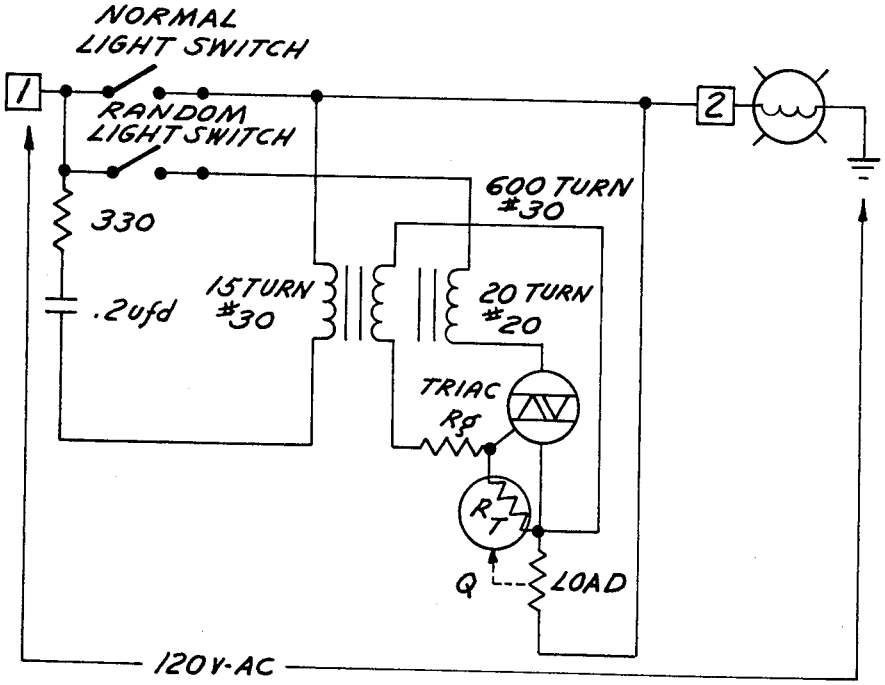
FIG. 9 illustrates circuitry for an in-the-wall application where a series electrical connection is possible.

FIG. 9 shows an in-the-wall application where a series electrical connection for example to a rheostat and lamp is possible. Here the selector switches control the lamp as:

1. a standard on-off light circuit
2. a random light control.

The circuit is self contained and controls the lamp in an identical manner as in FIG. 8, but the transformer has an additional coil which provides the proper bias to the triac. Here a conventional wall switch would be replaced by the Random Pulse Detector switch and allow a built-in appliance or a lamp to be controlled randomly as in a porch light, backyard light or bathroom light.

The overall improvement beyond the aforementioned patented system now allows multiple units to be located throughout a house and in connected or separate buildings where all of the separate units establish independent lighting or control profiles based on production variations, thermal characteristic variations and pulse reception times thereby providing substantially increased versatility over the prior system. It is of course clear that in the system of FIG. 7 the timer used in FIG. 3 may be employed to limit the random cycles to a preferred time frame if desired.

Figure 10:
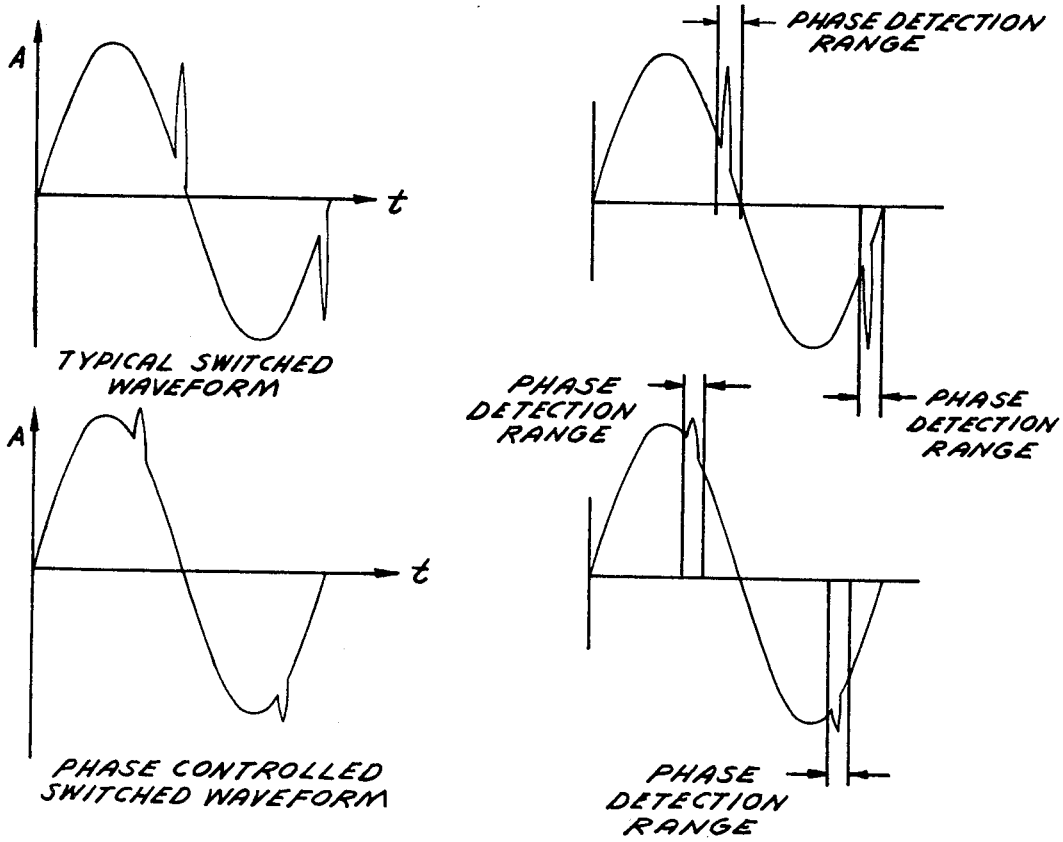
FIG. 10 illustrates typical switched and phase controlled waveforms which may be utilized to control various units tuned to receive the phased pulses.

FIG. 10 illustrates that since the triac switching pulse has a "signature" its characteristic signal can be produced and sensed over and above normal line noise if so desired. This allows the phase relationship of the pulse on the waveform to also be utilized to control and be received at various units "tuned" to receive the phased pulses as shown in the lower waveforms of FIG. 10.

Figure 11:
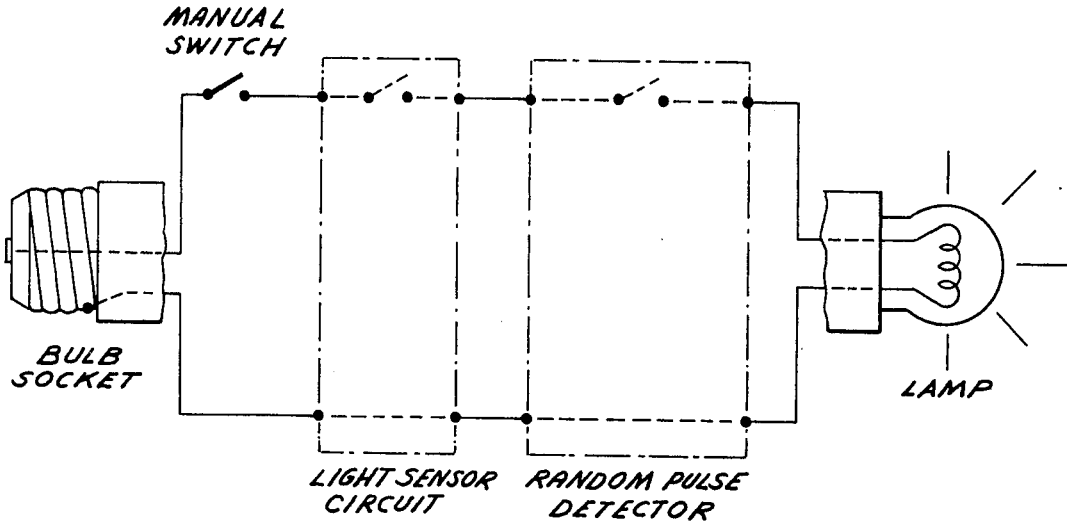
FIG. 11 illustrates a unit capable of intermediate installation between a lamp and bulb socket including a manual switch, light sensor unit and random pulse detector.

FIG. 11 shows a unit capable of intermediate installation between a lamp socket and the normal lamp bulb incorporating a manual switch in series with a light sensor circuit for detecting the room light level. Such lamp could be located near an appropriate window since exterior sun lighting on the outside can be differentiated from an incandescent source on the inside so that power in line with the manual switch and bulb socket and in series with the Random Pulse Detector circuit would switch in and out in its normal random mode only when the light sensor circuit had been activated by the lack of daylight. This would in turn control a conventional incandescent lamp or similar source to turn the lamp on and off in response to random pulses being detected and the manual switch being activated on and the light sensor circuit detecting the lack of illumination beyond the lamp from daylight. Everything would thereby be controlled by the normal lamp installation as it would plug into the wall and be mounted in either a remote lamp away from the wall or into a bulb socket in the ceiling or similar outlet.

Commercially available triacs in the 200 to 400 volt peak inverse voltage range having a current rating of 6 to 8 amps. are suitable for use in the various embodiments of the present invention. Examples are RCA 40486, a 6 amp. triac and HUTSON ID 48, an 8 amp. triac, each having two terminals (cathode and anode) and a pulse gate. Suitable transformers are employed to amplify the pulse to supply sufficient current coordinated with proper gate resistance and primary coupling circuit values. In the case of FIGS. 7 and 9 embodiments where heat from the triac warms the varistor/-thermistor, a suitable commercial thermistor is the Fenwall KB 22 J 1 in which the shunt resistance drops during heating to a sufficient low value to shut off the triac within a period of approximately 15 to 20 minutes, and thereafter cools at a variable rate depending on conditions such as room temperature to a point where the next significant pulse in the supply line will again trigger the triac. In a typical evening's operation such random circuit lighting may occur 5 to 6 times at each location where a random pulse detector is installed.

I claim:

1. A system for automatically switching a light circuit on for limited periods at random times comprising, electrical means for insertion anywhere in a current supply circuit, said electrical means having voltage pulse sensing triac means for energizing said light circuit, and time limited triac energizing circuit means for maintaining said triac means and light circuit on.

2. The system of claim 1 including a master triac pulse generating unit for insertion in the load circuit of an electrical appliance having random on/off operating characteristics, said voltage pulse sensing triac means being capable of continuous actuation by said triac pulse generating unit during "on" operation of said appliance.

3. The system of claim 1 including time limited holding circuit means within said electrical means for continuously energizing said voltage pulse sensing triac means.

4. The system of claim 3 wherein said time limited holding circuit means includes a varistor/thermistor, in a shunt circuit for the gate of said pulse sensing triac means, having a lowering resistance with increased heating to progressively reduce gate actuating voltage until it is insufficient to effectively energize said triac means.

5. The system of claim 1, 2, 3 or 4 including transformer means to amplify said voltage pulse in order to supply sufficient gate current to said triac means.

6. The system of claim 5 including a manually actuated reset button to switch off said holding circuit pending the next voltage pulse sensed by said triac means.

7. The system of claim 5 including a parallel normal light switch circuit bypassing said system.

8. The system of claim 5 including light sensor means for disabling said system during daylight hours.

9. The system of claim 2 including selective triac pulse generating means for limiting actuation of said voltage pulse sensing triac means to waveforms utilized to control and be received at various units tuned to receive the phased pulses.

10. The system of claim 5 including timer means to limit the effective time of operation for said system.

11. The system of claim 5 including antenna actuated means for said voltage pulse sensing triac means.

* * * * *